US006332239B1

(12) United States Patent
Dubos et al.

(10) Patent No.: US 6,332,239 B1
(45) Date of Patent: Dec. 25, 2001

(54) VACUUM CLEANER WITH TANGENTIAL SEPARATION OF TRASH

(75) Inventors: Roland Dubos, Richeville; Vincent Fleurier, Nancay; Marc Thery, Saint Suliac, all of (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 09/462,801

(22) PCT Filed: May 12, 1999

(86) PCT No.: PCT/FR99/01131

§ 371 Date: Jan. 14, 2000

§ 102(e) Date: Jan. 14, 2000

(87) PCT Pub. No.: WO99/59458

PCT Pub. Date: Nov. 25, 1999

(30) Foreign Application Priority Data

May 15, 1998 (FR) ..... 98 06422

(51) Int. Cl.[7] ..... B04C 1/00; B04C 3/06

(52) U.S. Cl. ..... 15/353; 15/327.2; 55/456

(58) Field of Search ..... 15/327.1, 327.2, 15/353; 55/456, 457, 429

(56) References Cited

U.S. PATENT DOCUMENTS 1,809,375 * 6/1931 Chase .
2,847,087 * 8/1958 Johnson .
2,849,080 8/1958 Enright .
3,597,901 * 8/1971 Heeney .
3,925,045 12/1975 Cheng .
4,008,059 * 2/1977 Monson et al. .
4,569,687 * 2/1986 Feng .
5,294,410 * 3/1994 White .
5,350,432 9/1994 Lee .

FOREIGN PATENT DOCUMENTS 815 788 7/1998 (EP) .
827 710 11/1998 (EP) .
8-322768 12/1996 (JP) .
96/21389 7/1996 (WO) .

* cited by examiner

*Primary Examiner*—Terrence R. Till
(74) *Attorney, Agent, or Firm*—Browdy and Neimark

(57) ABSTRACT

The invention concerns a device for separating and collecting trash for a trash collecting apparatus such as a vacuum cleaner, said device comprising a first tube with an air intake (13) capable of receiving the air sucked in and an air delivery outlet, a screw (11) substantially axially positioned in said first tube (8*a*), a second tube (9) with a diameter smaller than the screw external diameter and coaxially located in the first tube (8*a*) extension, in ventilating communication though one end to the first tube (8*a*) delivery end and connected by its other end to the suction unit by a first discharge conduit (14). The invention is characterised in that said device comprises a third tube (8*b*) arranged around the second tube (9) and connected to the first tube (8*a*) delivery end so as to provide between the second and third tubes (9, 8*b*) a second conduit for discharging the trash towards a filter and/or a container (10) in a secondary output flow.

17 Claims, 7 Drawing Sheets

VACUUM CLEANER WITH TANGENTIAL SEPARATION OF TRASH

TECHNICAL FIELD

The present invention concerns a device for collecting dirt intended to equip a vacuum cleaner.

PRIOR ART

In a conventional manner, there is provided, in this type of appliance, between the suction opening which will be termed "floor nozzle" in the remainder of this document and the suction motor, a bag for recovering dirt. This bag constituted in part of a material that is permeable to air, called media, performs on its internal surface the filtration of the gaseous fluid while retaining the solid particles that it contains. When it is full and/or plugged, this bag, generally of paper, sometimes of fabric, must be either replaced or emptied and cleaned by the user. The drawbacks connected with this operation, which are less acceptable as they are more frequent, can relate to its cost, but also to the unpleasantness occasioned by the removal, the handling and the reinstallation of the bag in the body of the appliance.

During filling of this bag, this latter becomes less and less permeable to air: pores of the media become blocked little by little with arrival of particles having small dimensions corresponding to the size of the pores creating the plugging which has been mentioned above. This plugging is translated into an increase in the loss of pressure in the passage of the bag, i.e. an increase in the pressure difference which exists to one side and the other of the media. After a prolonged period of use of the vacuum cleaner furnished with the same bag, a plugging appears and is thus amplified. It affects the vacuuming conditions in which there are assured the detachment of the particles in the zone in contact with the floor to be cleaned, that of the floor nozzle, the transport of said particles toward the bag but also the operating speed of the motor: this plugging provokes a drop in the flow rate, consequently degrading the effectiveness of the dust removal, while the speed of the motor increases, diminishing, by this fact, its useful life.

There are also known vacuum cleaners furnished with filtration means called cyclonic, particularly in the industrial field. Such devices permit a reduction in the frequency of intervention on the filters situated downstream of said means, if not being able to always dispense therewith completely. They act as true pre-filters. Naturally, the more effective this pre-filtration, i.e. having the capacity to collect particles of small size, the filters situated downstream thereof must be replaced less frequently. There flow therefrom vacuuming conditions which are more constant over time and thus more favorable at the same time to the useful life of the motor and the effectiveness of the dust removal.

In a first type of vacuum cleaner marketed by the NOTETRY Company, under the tradename DYSON, air loaded with dust is introduced tangentially under the upper cover of a frustoconic body oriented toward the bottom and opening into a lower container. In this body, air thus follows a helical descending path projecting solid particles against the internal face of the conical wall, these particles then falling by gravity along the wall into the container. At the end of the spiral, the air freed of solid particles travels back up along a central column and passes through a vertical tube passing through the center of the cover. The document WO96/21389 describes a more developed vacuum cleaner of this type having two cyclones provoked by two concentric chambers.

The particles which are the finest and thus very often the lightest have a tendency with regard thereto to be entrained by the flow, the centrifugal forces referred to above then only playing, with respect to said particles, a secondary role with respect to the entrainment forces. These particles are only recovered downstream of the device by means for example of pleated filters.

There exists numerous variants of such devices such as those presented in U.S. Pat. No. 3,925,045, utilizing several truncated cones, oriented toward the bottom, nested vertically in one another. More precisely, the small diameter of the lower part of a cone is slightly greater than the large diameter of the upper part of the following lower cone in such a manner as to leave between them a circular passage for dust pinned against the periphery by a cyclonic current induced by a tangential introduction.

The dust container must itself also be emptied regularly. This intervention being able to be found distasteful, is common to give the dust container large dimensions. It is necessary however to note that the fact of retaining a large quantity of dust during long periods promotes bacterial and/or microbial development within this storage zone.

It can also appear judicious to conceive of a system which permits easier and more regular removal with a smaller container of collected dirt. This will have in fact as an advantage to limit the size of the device, size which, in the case of the devices mentioned above, is very detrimental to the general ergonomics of the appliance (weight, maneuverability . . . ).

There will also be found in the prior art devices, such as that described in the patent application EPO 815 788, with a cyclonic centrifuging of the solid particles of which the device for introduction of dust, for example a helical tube, differs substantially from the prior systems. The filtration remains a cyclonic filtration to the extent where the flow is of the same type as that previously described. The originality resides above all in the fact that fine dust is captured due to the accumulation of electric charges, generated upon passage of solid particles into the introduction device, along external walls of this latter which the material forms, for the use, the object of a careful selection. The objective here is to improve the effectiveness of the pre-filtration of the conventional cyclones. This configuration remains however voluminous.

In addition, all of the devices have in addition as an inconvenience that they generate substantial pressure losses.

There is also known, in certain particular military applications, pre-filtration systems different from cyclone systems, called GD Systems in the remainder of the document: air is introduced into a tube which contains a screw positioned, on the axis of the tube, at one extremity of this latter, termed inlet or injection. It is of an exterior diameter substantially smaller than the diameter of the internal wall of the tube (from 20 to 60% smaller). Its role is to place the air in rotation and to centrifuge the solid particles in order to press them on said internal wall. In the extension of the extremity of the screw, on the same axis as that of the tube and of the screw, there is disposed at a certain distance another tube, called evacuation, always contained in the preceding tube, with a diameter equal to or less than the exterior diameter of the screw which assures the delivery of a certain proportion of the introduced dust removal air. In the space separating the external wall of the internal tube from the internal wall of the external tube there is arranged an adjoining exhaust which evacuates the remaining portion of the air, loaded, as regards it, with solid particles. In this type of application the already dirty air delivered by the adjoining exhaust is rejected sometimes directly to the outside.

This configuration is not however adapted to the conditions imposed by a utilization within a vacuum cleaner. In particular, the flow rates, the pressure drop levels, the passage cross sections and thus the sizes, the variety of dirt to be treated (which can be present, in the case of the vacuum cleaner, in the form of dirt which is fibrous, powdery, bread crumbs . . . ) differ greatly from a military to another household application.

The present invention relates to a pre-filtration device applied to the household field which offers the same advantages in terms of results and filtration quality as the devices previously described, while reducing the size, and limiting the pressure losses.

In addition, the structure and arrangement of the constituent parts must permit fabrication at a reasonable cost.

SUMMARY OF THE INVENTION

The present invention is achieved with the aid of a device for separating and collecting dirt for a dirt collecting appliance of the vacuum cleaner type comprising particularly a suction group connected to the surface to be vacuumed by a pipe terminated by a floor nozzle, said device comprising a first tube having an air intake capable of receiving suctioned air and guided by the pipe and an air delivery outlet, a screw positioned in a substantially axial manner in this first tube, a second tube having a diameter less than the exterior diameter of the screw and situated coaxially in the extension of the first tube, in ventilating communication by one end to the delivery end of the first tube and coupled via its other end with the suction group by a first evacuation conduit, characterized in that this device comprises a third tube arranged around the second tube and connected to the delivery end of the first tube in such a manner as to arrange, between the second and third tube, a second conduit for discharging dirt toward a filter and/or a container in a secondary output flow.

Thanks to the use of a screw at the heart of a particular arrangement of tubes, one can arrange the separation device as well vertically, but preferably horizontally in a household appliance.

The filtration of dirt at the level of the interstice between the second and the third tube is proven effective permitting a substantial lengthening of the useful life of the filter without risk of damaging the motor of the suction group or of delivering to the exterior air which is still polluted.

According to a first form of construction of the invention, the secondary output flow is generated by the same suction group as the main flow by means of a shunt in the ventilating circuit. This first form of construction is a simple and economical means of achieving the invention since it only requires the use of one suction group.

In a second form of construction of the invention, the secondary flow rate utilized for the delivery of air loaded with dust is generated independently of the main flow, this secondary flow having to be maintained, by means of a second suction group, for example preferably at a value corresponding to 20% (from 5% to 30%) of that of the main flow.

In effect, in the preceding configuration, it can prove difficult to maintain the secondary flow at a constant level because the plugging of the filtration means utilized to perform the treatment of the dust laden air causes a drop in the flow rate in this branch of the circuit. If this latter is not sufficient, the filtration performance of the device which is the object of the present invention is degraded.

The advantage resides then in the fact that only 20% of the flow needs to be treated. At an equivalent passage cross-section, the air velocities then drop in the same proportions, the velocity being approximately divided by 5. One then multiplies the useful life of the filtration means, bag or pleated filter for example, by a factor of the same order. In effect, for a same rate of loading, the degradation is smaller in proportion as the speed is low.

In a third form of construction of the invention, the second discharge conduit is short and opens directly into a sealed dust container the ventilation of which is completed by a coarse filter intended to retain the dirt preliminarily centrifuged and separated from the main air flow. The secondary discharge flow is then mainly due to the kinetic energy acquired upstream by the particles, sufficient to transport them up to the adjacent container. Given that the air movements are less turbulent in this zone than they are in the upstream circuit, a storage can be carried out. This form of construction offers the advantage of not being costly and of remaining of small volume.

According to this last form of construction, the second tube preferably has lateral openings close to its inlet end. These openings permit a flow of air to be obtained in the zone situated between the two tubes, which is helical, and not only rotational, so that light and large size dirt particles follow their path in the container while being spaced from the delivery orifices (lateral and central holes). In this form of construction, the dirt falls by gravity into the container provided for this purpose and this will be advantageously placed in the lower part of the device. There is then provided, in the third tube, an opening in its wall in the direction of a container in order that the space provided between the second and the third tube is coupled with the internal volume of the container.

In the three exemplary cases set forth previously, several characteristics remain common. Contrary to the devices called "GD", the external diameter of the screw should be equal to the internal diameter of the tube in such a manner that there is not any play at this level between the two parts. This has for its consequence and advantage, on the one hand, to improve the centrifuging of the particles during their passage into the screw but also, on the other hand, to avoid any zone which can constitute a point of attachment for certain dirt having a propensity to be attached thereto: fluff, hairs and more generally fibrous dirt.

Preferably, the screw is provided with only one thread, without a central bore which could constitute an attachment point. It can nevertheless comprise several threads if it is desired to prevent occurrence of a preliminary centrifuging from pressing the dirt onto the lateral walls of the tube.

Advantageously, this screw has several active turns always diminishing along the air circuit, from upstream toward downstream, and this for two main reasons: the first is to progressively bring the air to circulate along the screw which has for its effect to greatly limit the pressure losses during its passage; the second is to limit the risks of blocking of the groove or grooves.

The smallest passage section of the screw should in addition correspond to the most restricted passage cross-section that one can find upstream of the device, generally in the floor nozzle, so that rigid dirt particles which cross this first obstacle will not be blocked in the screw.

Preferably, the length of the screw should be sufficient so that the centrifuging operation is effectuated correctly, despite flow variations created by restrictions in the cross-section of the passage for air in the zone of the floor nozzle induced by, on the one hand, the back and forth movement impressed by the user on the floor nozzle in question and, on the other hand, the nature of the surface from which dust is to be removed (carpets, smooth floors . . . ). If the decrease in the flow rate is too great, for example in the case where the floor nozzle is completely blocked, a case fortunately which occurs very rarely in practice, one can provide just upstream of the device a valve which opens the circuit to the exterior in case of an overly strong depressurization maintaining the flow at a suitable minimum level.

BRIEF DESCRIPTION OF THE DRAWINGS

The following description, in referring to the attached drawings, given by way of non-limiting examples, will clarify and bring to light all of the points set forth previously, the particularities which appear as much from the text as the drawings forming, of course, part of the invention.

BEST MANNER OF CONSTRUCTING THE INVENTION

Figure 1A:
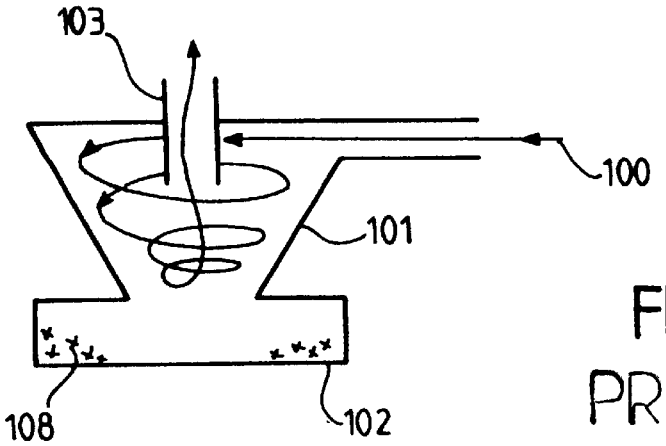
FIG. 1a PRIOR ART
FIG. 1*a* shows a diagram of the operating principle of a cyclone according to a first prior art.

On FIG. 1*a* appears an air flow line (100), firstly helical descending along the wall of a body, frustoconic (101), which then rises along the central axis of a delivery tube (103). Given that the particles collected (108) in the container (102) provided for this purpose owe their presence at this location to gravity, the system is preferably disposed so that the container is situated in the low part of the device. The air exiting therefrom is then loaded only with fine particle which are treated further downstream, if the application requires.

Figure 1B:
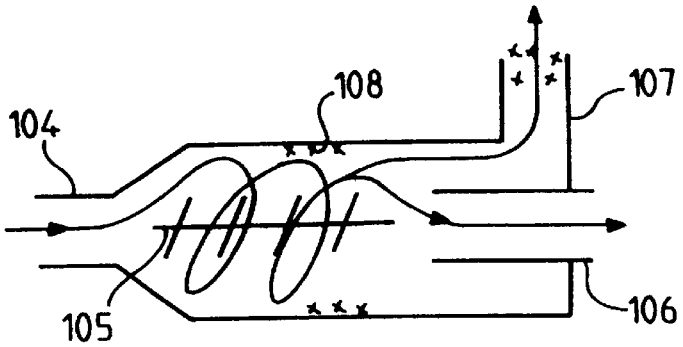
FIG. 1b PRIOR ART
FIG. 1*b* shows a diagram of the operating principle of a cyclone according to another prior art.

On FIG. 1*b*, the inlet of air if effectuated by the axis of the main tube (104) at one extremity of this latter. Upon arrival on the screw (105), the flow becomes helical, projecting by this fact the solid particles (108) on the internal wall of the tube (104). When the screw (105) is passed, the flow of air is split into two branches, the first leads air from which dust has been removed toward the main delivery tube (106), the second evacuates air loaded with dust through the secondary delivery orifice (107).

Figure 2B:
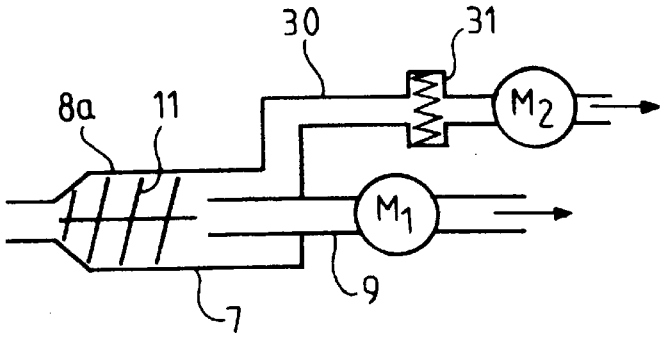
FIG. 2*b* shows a drawing of the operating principle of a first form of construction of a device according to the invention applied in a household vacuum cleaner.
Figure 2C:
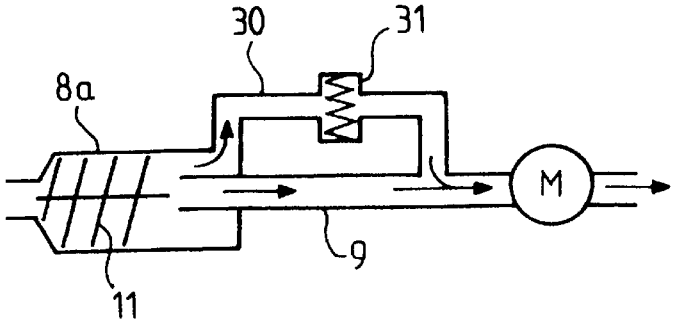
FIG. 2*c* shows a drawing of the operating principle of a second form of construction according to the invention.
Figures 2A, 2D:
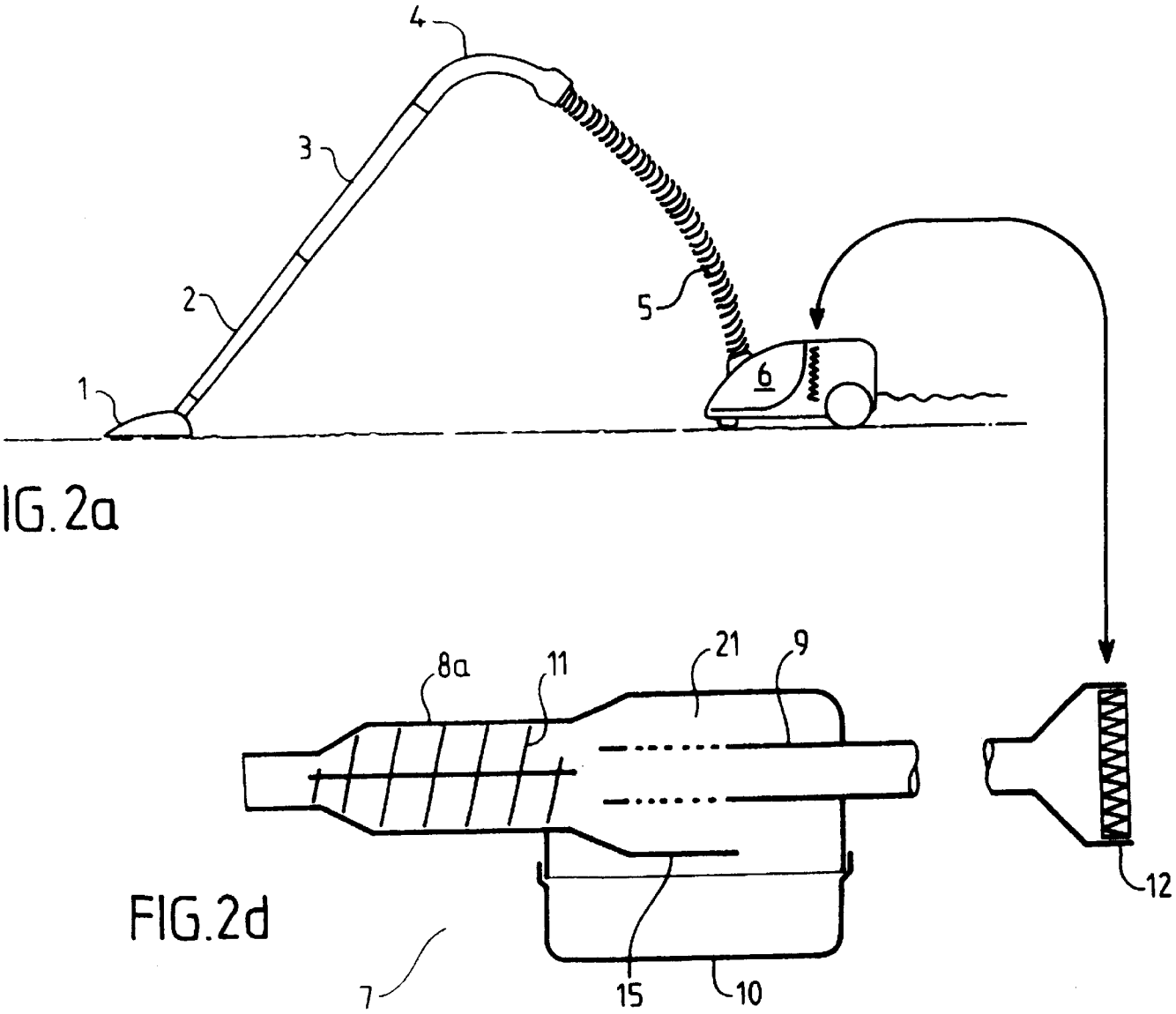
FIG. 2*a* is an overall schematic view of a complete suction chain at the heart of a vacuum cleaner.
FIG. 2*d* shows a drawing of the principle of a third mode of construction of a device according to the invention.

FIG. 2*a* shows a complete vacuum cleaner chain. In following the ventilating circuit, the air penetrates through the floor nozzle (1) then into the extensions (2,3), pursues its path into the handle (4), then into the flexible hose (5), to end in the housing (6) where the bag for recovering dirt is usually placed.

FIG. 2*b* shows a device according to the invention inspired by a "GD" device but transformed in order to be able to be mounted in a vacuum cleaner, forming the object of the present invention in the first form of construction. It is necessary to utilize two distinct suction sources marked on the drawing (M1) and (M2). "Dirty" air delivered by the secondary orifice (30) is treated by a filter (31) situated downstream between said orifice and the motor (M2) after a certain operating time. It is preferable in effect to prevent dust laden air from coming in contact with the turbine and/or the active parts, particularly electric, of the motor.

FIG. 2*c* shows the second form of construction. As specified above, the two delivery circuits merge further downstream, thus constituting the shunt which has been mentioned above. This configuration then only requires the use of a single suction group identified on the drawing by the letter (M). In return, after a certain operating time, the flow in the branch treating the dust laden air, thus including the filter, can no longer be sufficient to assure an optimum effectiveness of the device (by reason of the plugging of said filter).

The device which is the object of the present invention, a drawing of which is presented in FIG. 2*d* in its third form of construction, can be disposed at any location of this chain. A filter (12) should be placed downstream for the treatment of fine dirt. It can, as on the figure, be placed in the body of the appliance. It can be present in the form of a conventional paper or fabric bag, a flat or pleated filter . . .

Figure 3:
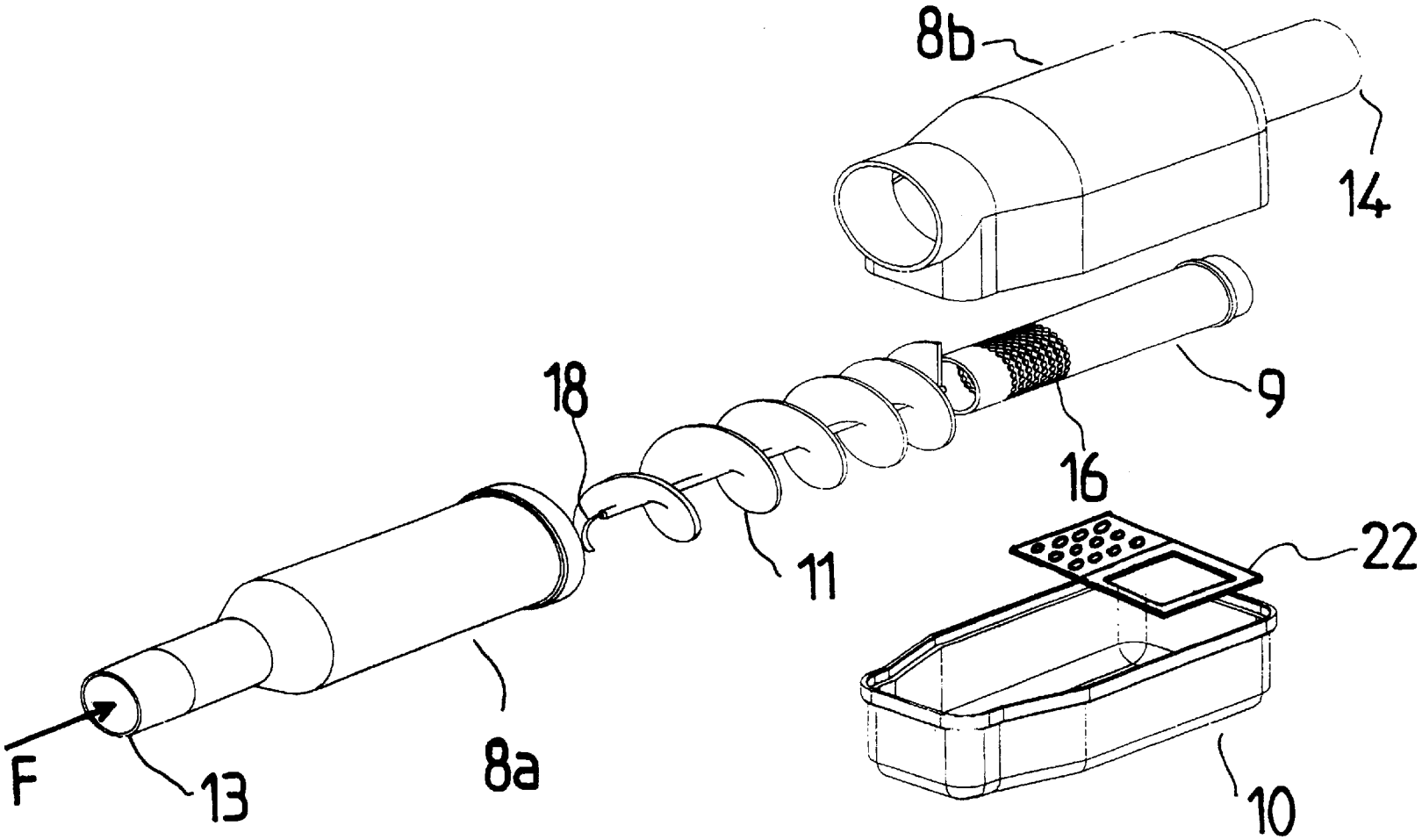
FIG. 3 is an exploded perspective view of the device according to a third form of construction of the invention.
Figure 4:
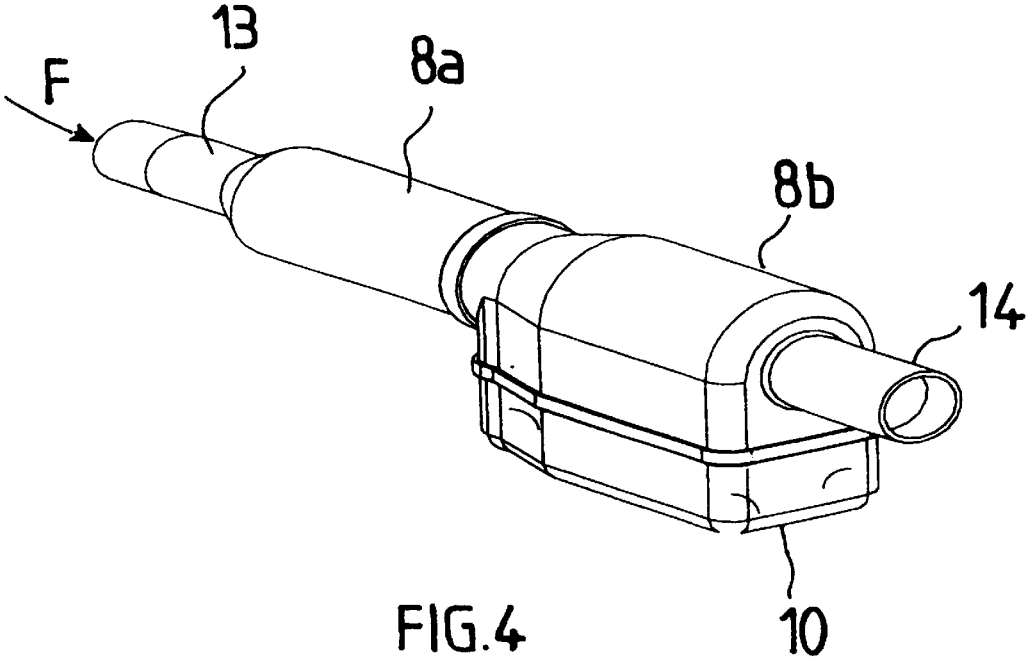
FIG. 4 is a perspective view of the device according to the third form of construction in the assembled state.

FIGS. 3 and 4 show the device which is the object of the present invention in its third form of construction. The aspects specific to this version concern the absence of the secondary delivery circuit and thus the presence of the tray for recovering dirt as well as the arrangement of lateral holes on the delivery tube. All that forms part of the description that follows, except for the two above-cited points, is in turn common to the three versions.

The tubes (8*a*, 8*b*) contain, in the same central axis, respectively the so-called separation screw (11) and the delivery tube (9). Air loaded with dust, making its entry through the end (13) of the tube (8), in the direction (F), is centrifuged by the screw (11). Between the exterior of the screw (11) and the internal diameter (K) of the tube (8*a*) there does not remain any play, in order to assure a good centrifuging of the solid particles and to avoid having any dirt become attached between these two parts in this zone. At a distance (A) from the screw (11), corresponding to around 5 to 20% of the internal diameter (K) of the tube (8*a*), is disposed the delivery tube (9). This distance (A) should be sufficient to prevent all dirt from being delivered into the delivery tube (9), but should not exceed a value for which the separated dirt recombines at the outlet of the first tube (8*a*), before entry into the second tube (9). The tangential separation depending on the internal diameter (K) of the tube (8*a*), the distance (A) is given as a fraction of this diameter.

In addition, the diameter of the delivery tube (9) is itself also optimized: it should not greatly exceed that of the tube (8*a*) in order to retain the effect of separation of the dirt induced by the screw (11) and should not be excessively too small with respect to the inlet diameter of the tube (8*a*), in order that too great a restriction of the cross-section will not come to generate a significant loss of pressure during passage of the air into the device. The preferred diameter of the second tube (9) is situated between 70% and 100% of the smallest internal diameter of the tube (8*a*), designated (L). The outlet of air in the part which is freed of dirt is effected in the extension of the tube (9) by the discharge tube (14). The tube (8*b*) covers over a length (E)+(H)+(G) the delivery tube (9) and comprises thus an opening (17) over a length (D). In the first two forms of construction of the invention, one benefits from this opening (17) to provide the secondary delivery orifice responsible for evacuating dust laden air. Preferably, the distance (D) is selected to be greater than 20% of the internal diameter (K) of the tube (8*a*).

In the third form of construction, this opening (17), always preferably greater than 20% of the internal diameter (K) of the tube (8*a*), leads to the dirt container (10). In the space separating the two tubes, over the length (E)+(H)+(G), a distance (B) is advantageously provided in order that the most voluminous dirt does not obstruct the conduit by jamming. This distance is preferably at least equal to 10% of the internal diameter (K) of the tube (8*a*). In the delivery tube (9), a lateral opening (16) is created. This opening permits conserving helical flow lines, necessary for the transport of solid particles from the outlet of the screw (11) to the opening (17) which communicates with the container (10), all while facilitating the delivery of air. It can for example be present in the form of holes. The cross section of this opening is equivalent to X% (X varying from 50 to 150) of the internal cross-section of the delivery tube (9). This zone is situated at a distance (G) from the extremity of the tube (9), and is extended over a distance (H), depending on the nature of the opening formed. A distance (E) preferably greater than one and a half times the internal diameter of the delivery tube (9) separates the end of the covering rib (15), extending the tube (8*a*) to the end of the opening (16).

Still in the same form of construction, the distance (C), defining the height of the dust container, should correspond to at least 150% of the internal diameter (K) of the tube (8*a*). If this distance is not respected, the dirt container becomes the site of a turbulent flow which is not favorable to the storage of dirt in the zone, in particular large lightweight particles of dirt. If it is desired however to maintain a compact assembly by limiting particularly this distance (C), as in the example proposed, a desire which can be motivated by considerations connected to hygiene (creation of a storage zone of small volume, that the user would empty after each use), one can insert in the delivery path, in the zone (17), a screen (22) which retains the large and lightweight particles. In practice and effect, if the storage is not effective, this dirt will inevitably come to obstruct the lateral opening (16) leading to a rapid and substantial degradation of the performance of the device. This screen (22) preferably has a large mesh and is fixed to the dust container in order to facilitate the operation of emptying the container (10).

Figure 6:
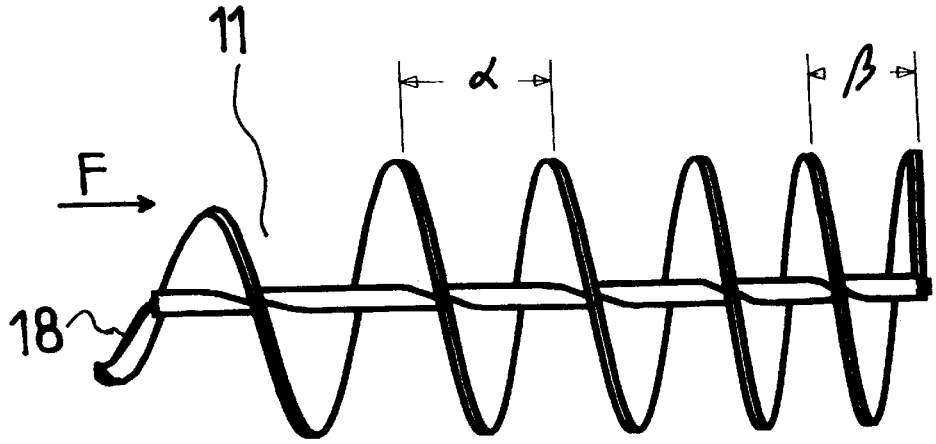
FIG. 6 illustrates the detail of a screw incorporated into the device according to the invention.

The separation screw (11), shown in FIG. 6, is conceived to limit the loss of pressure in its passage and to avoid any phenomenon of jamming and/or attachment of the fibrous dirt. Advantageously, the thread pitch of the screw is variable for the purpose of progressively leading the air to follow the helical form of the ventilating vein or veins. In FIG. 6, the air is guided through the screen by the intermediary of a helix having two thread pitches, $\alpha$ and $\beta$. The progression of the thread pitch should always decrease in the direction of flow. Thus, in the case of the screw (11) shown in FIG. 6, the pitch a is greater than pitch $\beta$.

The progression of the pitch of the screw can be continuous or discontinuous, this latter possibility being however less costly to produce.

Thus the cross section of the vein should always be equal to or greater than the smallest passage cross section situated upstream of the device so that the largest rigid dirt particles which can cross this first obstacle cannot become blocked in the screw. Preferably, this screw includes only one helix to avoid any zone of attachment in proximity to the axis of the screw (11). One can nevertheless envision that it includes several of them on the condition that a preliminary centrifuging performed by other means takes place upstream. At the inlet (13) of the device the helix should not present any crest contained in a plane perpendicular to the axis of the screw (11), to avoid any potential attachment zone. The helix, in proximity to the inlet (13), takes its origin along the internal wall of the tube (8*a*) to return further down to its axis so that the surface containing the crest (I18) forms with the axis of the screw (11) a small angle, at most 45°. The dirt rather than attaching there comes to slide along this crest (18).

Figure 5:
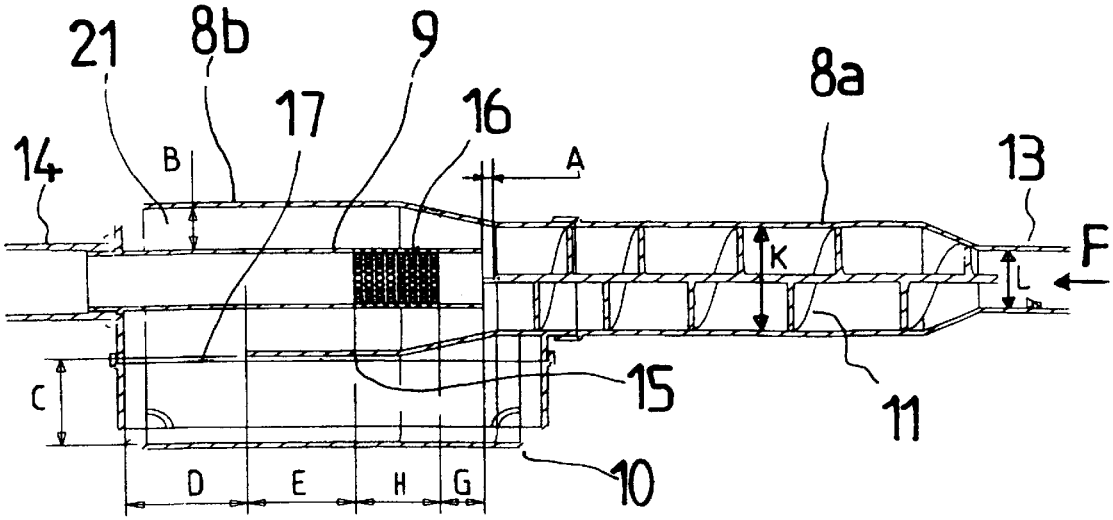
FIG. 5 is a longitudinal cross-sectional view of the device of FIGS. 3 and 4.

As shown in FIG. 5, the tube (8*b*) is arranged around the delivery tube (9) in such a manner as to provide, between those tubes, a second conduit (21) for discharging dirt toward the container (10) in a secondary output flow. According to one form of construction, the second conduit (21) is connected by a shunt to the main suction group of the vacuum cleaner.

Figure 8:
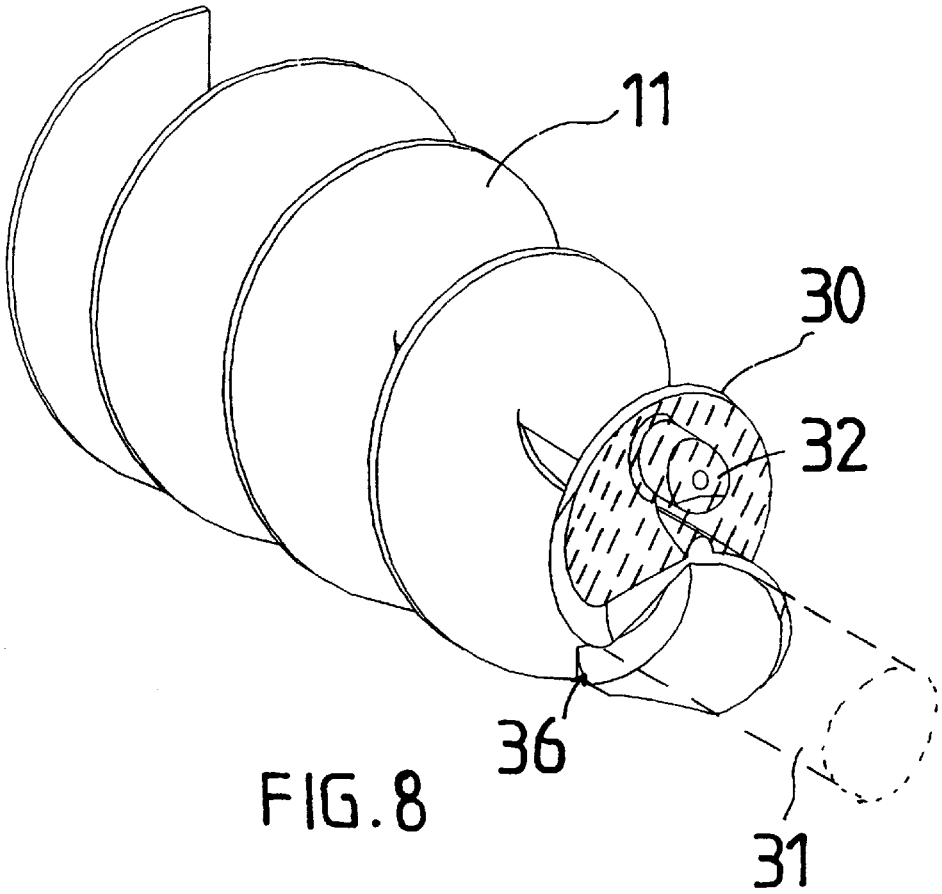
FIG. 8 shows a variant of construction of the screw in a perspective view.
Figure 9:
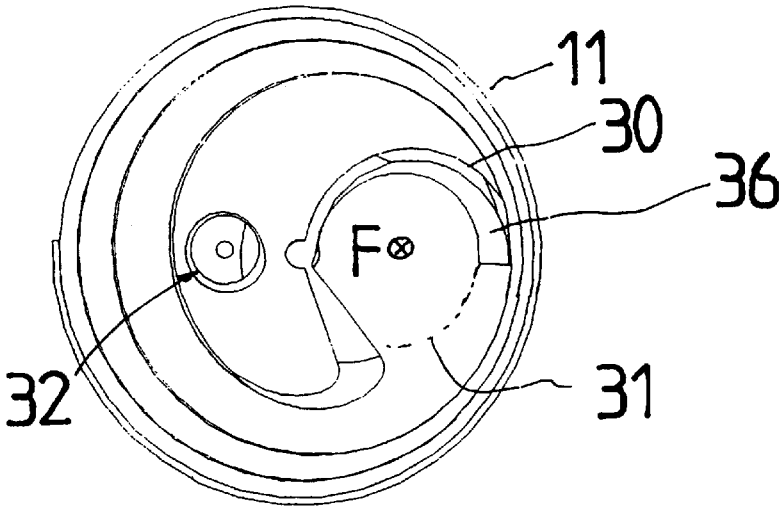
FIG. 9 shows the same variant of construction of the screw as FIG. 8, in a front view.
Figure 10:
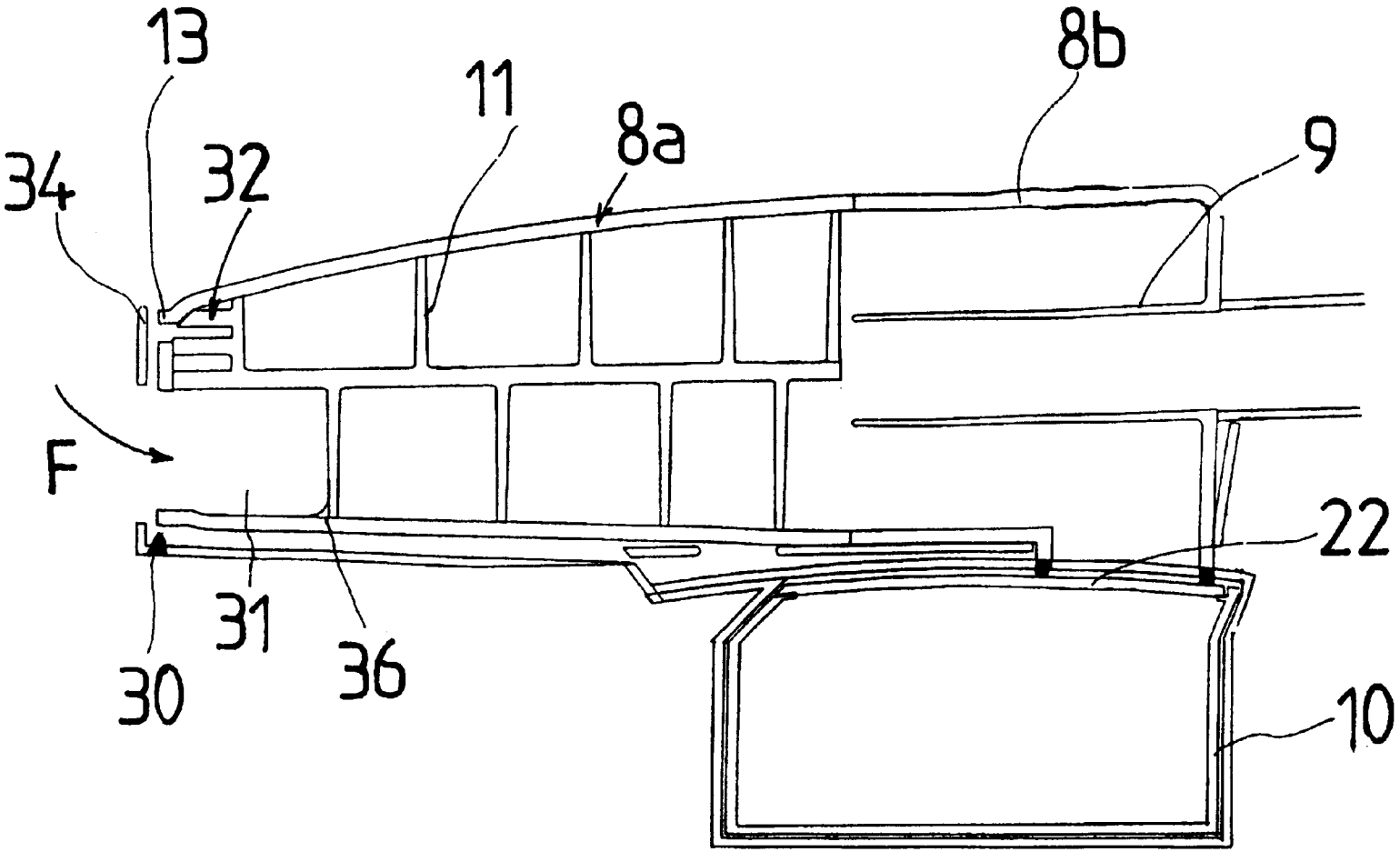
FIG. 10 indicates the positioning of the screw according to the variant presented in FIGS. 8 and 9 in a partial cross-sectional view.

A variant of construction of the screw (11) is presented in FIGS. 8 to 10. This variant is characterized in that the end of the screw (11) situated at the air intake side is partially closed in a manner such that aspiration of air by the screw (I11) at this end is achieved along a substantially tubular channel and does not include any crest.

As is clearly visible in FIG. 10, the end (30) of the screw (11), situated at the level of the air intake in the separation device, is shaped with the extremity (13) of the tube (8*a*) in such a manner that air penetrates into the screw by the intermediary of a channel (31) free of any crest.

Thus, the screw (11) is fixed in a housing by the intermediary of a pin (32). The housing receiving the filtration system includes a closing element (34) blocking a part of the end (30) of the screw (11).

In this way, air penetrates into the screw (11) along a channel delimited by the thread of the screw, the internal wall of tube 8*a* and the central core when it exists. This channel corresponds to around one-half of the diameter of the intake of the screw. On FIG. 8 is indicated, by hatching, the intake zone blocked by the screw. The intake of air into the device is thus off center.

The leading edges can be rounded, so that no obstacle, placed in the off center aspiration flow, is likely to retain the dirt (notably threads and fibers) at the level of the air intake of the screw.

Advantageously, as shown in FIGS. 8 to 10, an inclined blade (36) is located at the intake of the screw (11) in order to reduce the force of the intake of air on the blade of the screw and limit the losses of pressure resulting from the arrival of the air on said screw (11).

Moreover, as shown in FIGS. 9 and 10, the envelope containing the generatrix of the screw is not a surface of revolution, which permits a gain in space at the lower part for the housing of the motor. The axis of the screw (11) does not remain there less substantially parallel to the axis of the tube (8*a*).

The length of the screw (11) must finally be sufficient to guarantee a minimum effectiveness in the case of operation at a reduced flow rate. This length must preferably correspond to at least 2 times the internal diameter (K) of the tube (8*a*).

Figure 7A:
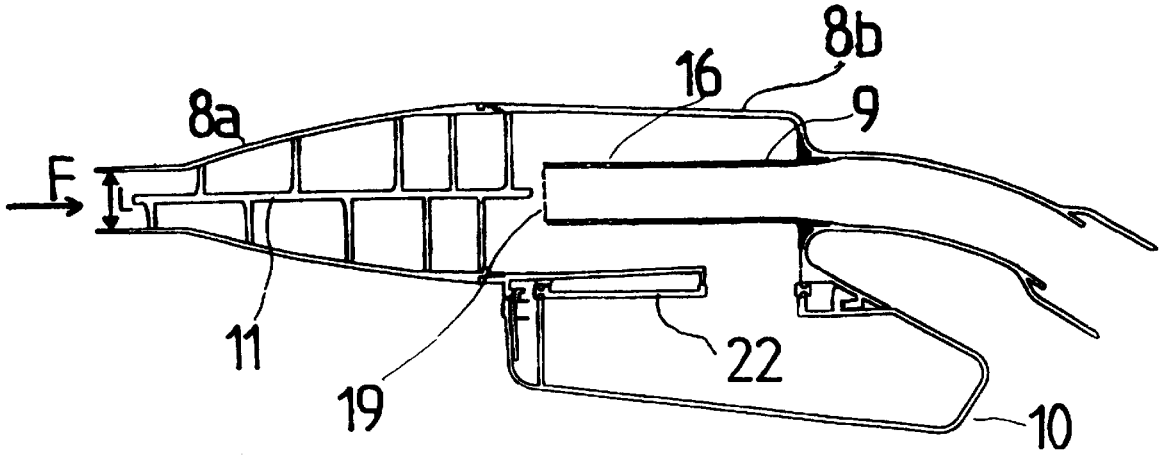
FIG. 7*a* illustrates a longitudinal cross-sectional view of a variant of the device of FIG. 5.
Figure 7B:
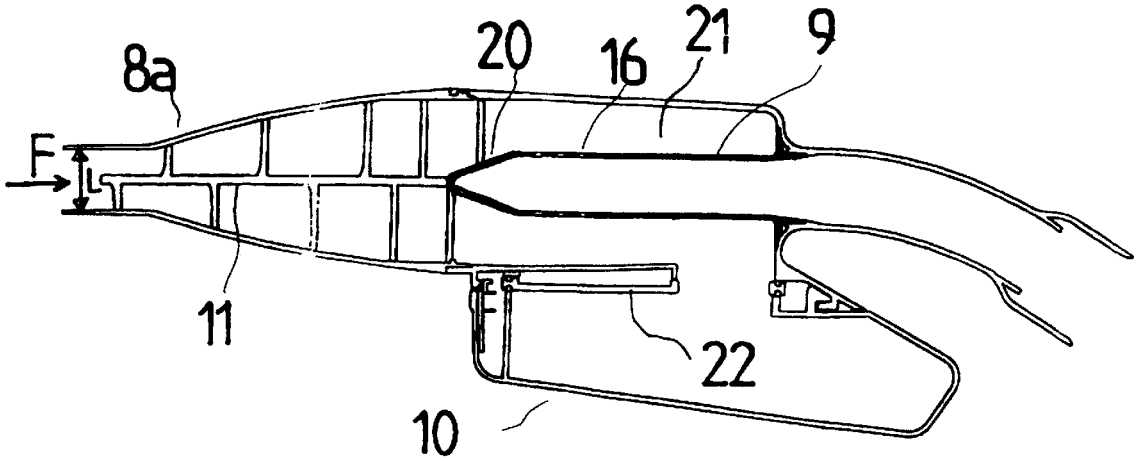
FIG. 7*b* illustrates a longitudinal cross-sectional view of another variant of the device of FIG. 5.

In order to guarantee an optimal operation of the appliance, there can be provided a translucent container (10) in order to view the rate of filling with dust. It is in effect important to guard that this container does not become overly filled and consequently to empty it frequently. It can be harmful to the appliance to overly fill the container with dirt since this dirt can reach the delivery tube (9), then representing a danger for the motor, situated downstream of the tube (9). In order to avoid this difficulty, there can be provided a screen (19) having a relatively large mesh on the intake face of the delivery tube (9), as shown in FIG. 7*a*. FIG. 7*b* shows a more developed version of the principle stated where an open cone (20) constitutes the anti-overflow system.

This pre-filtration device can be disposed in the vacuum cleaner during its fabrication at a factory, for example in the housing of the appliance, in a preferably horizontal position for a canister type appliance, or vertical for a tank type or electric broom type appliance. The fact of being able to conform to the general form of the body of the vacuum cleaner, and not to impose a particular form on the vacuum cleaner by the fact of utilization of the device, permits an overall reduction in the size of the appliance.

Moreover, as one can see on the different figures, the pre-filtration device forms a self-contained filtration assembly which can be integrated at any point in the ventilating chain of the appliance by connecting the inlet end of the first tube to the conduit comprising the floor nozzle (1) connected to the surface to be cleaned and by connecting the outlet end of the second tube to the suction circuit of the vacuum cleaner. It can thus be considered, by itself, as a filtration accessory, or even as a suction nozzle, being able then to be inserted into any vacuum cleaner, without specific equipment, for example at the level of the handle for holding the extensions of the floor nozzle, or at the level of these extensions, or at the level of the floor nozzle itself. As an accessory, it thus permits an augmentation of the performance and the useful life of the majority of appliances for collecting dirt without a complicated intervention onto the appliance and in an economical manner.

POSSIBILITY OF INDUSTRIAL APPLICATION

The invention finds its application in the technical field of vacuum cleaners and in devices for collecting dirt.

What is claimed is:

1. A device for separating and collecting dirt from a floor, a dirt collecting appliance of the vacuum cleaner type comprising particularly a suction group connected to the surface to be vacuumed by a pipe (2, 3, 4) terminated by a floor nozzle (1), said device having a first tube (8*a*) having an air intake (13) capable of receiving suctioned air and guided by the pipe and an air delivery outlet, a screw (11) positioned in a substantially axial manner in this first tube (8*a*), a second tube (9) having a diameter less than the exterior diameter of the screw (11) and situated coaxially in the extension of the first tube (8*a*), in ventilating communication by one end to the delivery end of the first tube (8*a*) and in communication via its other end with the suction group by a first evacuation conduit (14), characterized in that the device comprises a third tube (8*b*) arranged around the second tube (9) and connected to the delivery end of the first tube (8*a*) in such a manner as to arrange, between the second and third tube (9, 8*b*) a second conduit (21) for discharging dirt toward a filter and/or a container (10) in a secondary output flow.

2. A device according to claim 1, characterized in that the second discharge conduit (21) is connected to a suction group.

3. A device according to claim 2, characterized in that the secondary flow rate in the second discharge circuit (21) is maintained, by a second suction group, between 5 and 30% of main flow rate.

4. A device according to claim 1, characterized in that the second discharge conduit (21) is connected, by a shunt, to the main suction group of the vacuum cleaner.

5. A device according to claim 1, characterized in that the second discharge conduit (21) is short and leads directly into a sealed dust container (10) of which the ventilating outlet is completed by a coarse filter (22) provided to retain dirt.

6. A device according to claim 5, characterized in that the second tube (9) includes lateral openings (16) close to its inlet end.

7. A device according to claim 5, characterized in that the third tube (8*b*) includes an opening (17) in its wall in the direction of the container (10) in order that the space provided between the second tube (9) and the third tube (8*b*) is in communication with the internal volume of the container (10).

8. A device according to claim 1, characterized in that the exterior diameter of the screw is substantially equal to the interior diameter (K) of the first tube (8*a*).

9. A device according to claim 1, characterized in that the screw (11) does not have a central bore.

10. A device according to claim 1, characterized in that the screw (11) has one or several threads.

11. A device according to claim 1, characterized in that the pitch of at least one of the threads of the screw (11) is longitudinally variable.

12. A device according to claim 1, characterized in that the end (30) of the screw (11) situated at the air intake side is partially blocked in a manner such that suction of air by the screw (11) at this end is achieved along a substantially tubular channel and does not include any crest.

13. A device according to claim 1, characterized in that a distance (B) at least equal to 10% of the internal diameter (K) of the tube (8*a*), is provided between the second tube (9) and the third tube (8*b*).

14. A device according to claim 1, characterized in that the second tube (9) is disposed at a distance (A) from the screw (11) corresponding to around 5 to 20% of the internal diameter (K) of the first tube (8*a*).

15. A device according to claim 1, characterized in that the device is integrated into the housing (6) of the vacuum cleaner.

16. A device according to claim 1, characterized in that the device is mounted substantially horizontal in the vacuum cleaner.

17. A device according to claim 5, characterized in that the device is an accessory for a vacuum cleaner capable of being inserted into the suction ventilating path, by connecting the intake end of the first tube (8*a*) to the conduit including the floor nozzle (1) coupled to the surface to be vacuumed, and by connecting the discharge end of the second tube (9) to the suction circuit of the vacuum cleaner.

* * * * *